US011517079B2

(12) United States Patent
Suvilaakso et al.

(10) Patent No.: US 11,517,079 B2
(45) Date of Patent: Dec. 6, 2022

(54) WATCH STRAP

(71) Applicant: Polar Electro Oy, Kempele (FI)

(72) Inventors: Anna-Marja Suvilaakso, Kempele (FI); Olli Komulainen, Kempele (FI); Kaisa Lämsä, Kempele (FI); Katri Ervasti-Taskila, Kempele (FI); Marko Tuhkala, Kempele (FI); Seppo Korkala, Kempele (FI); Veli-Pekka Putila, Kempele (FI)

(73) Assignee: Polar Electro Oy, Kempele (FI)

( * ) Notice: Subject to any disclaimer, the term of this patent is extended or adjusted under 35 U.S.C. 154(b) by 506 days.

(21) Appl. No.: 16/686,102

(22) Filed: Nov. 16, 2019

(65) Prior Publication Data

US 2020/0163420 A1 May 28, 2020

(30) Foreign Application Priority Data

Nov. 23, 2018 (CN) ..... 201821949516.0

(51) Int. Cl.

| | |
|---|---|
| ***A44C 5/00*** | (2006.01) |
| ***A44B 11/00*** | (2006.01) |
| ***G04B 37/14*** | (2006.01) |

(52) U.S. Cl.

CPC ..... *A44C 5/0053* (2013.01); *A44B 11/00* (2013.01); *G04B 37/1486* (2013.01)

(58) Field of Classification Search

CPC ..... A44C 5/0053; A44C 5/0069; A44B 11/00; A44B 11/008; G04B 37/1486

See application file for complete search history.

(56) References Cited

U.S. PATENT DOCUMENTS

| | | | | | |
|---|---|---|---|---|---|
| 2,280,490 | A * | 4/1942 | Keltie | A44C 5/0053 | 224/178 |
| 3,664,559 | A * | 5/1972 | Bruner | A44C 5/14 | 24/376 |
| 3,695,494 | A * | 10/1972 | Bruner | G04B 37/1486 | 24/906 |
| 3,830,414 | A * | 8/1974 | Caprielian | A44C 5/00 | 63/3 |
| 4,513,896 | A * | 4/1985 | Hirsch | A44C 5/0053 | 224/178 |
| 6,256,847 | B1 * | 7/2001 | Manley | A44B 11/258 | 24/593.11 |
| 7,070,322 | B1 * | 7/2006 | Field | G04B 37/00 | 368/282 |
| 2010/0292599 | A1 * | 11/2010 | Oleson | A63B 71/0686 | 600/519 |
| 2016/0282899 | A1 * | 9/2016 | Inagaki | H04B 5/0075 | |

* cited by examiner

*Primary Examiner* — David M Upchurch
(74) *Attorney, Agent, or Firm* — FisherBroyles, LLP

(57) ABSTRACT

A watch strap includes a substantially inflexible main portion, a flexible auxiliary portion coupled to the substantially inflexible main portion, and a tightener coupled to the flexible auxiliary portion. When in use, the tightener is configured to maintain a selected tightness, and the flexible auxiliary portion is configured to be elastic.

18 Claims, 5 Drawing Sheets

WATCH STRAP

CROSS-REFERENCE TO RELATED APPLICATION

This application claims priority to Chinese Application No. 2018219495160, filed Nov. 23, 2018, which is incorporated by reference here-in in its entirety.

BACKGROUND

Field

Various embodiments relate to a watch strap.

Description of the Related Art

A watch strap may be used to attach an electronic or mechanical device such as a smartwatch around a wrist. Fit of the watch strap should be comfortable, but at the same time tight enough so that the smartwatch does not move around. In case of a smartwatch, a loose fit may impede measurements such as an optical heart rate measurement from the wrist.

SUMMARY

According to an aspect, there is provided subject matter of claim 1. Dependent claims define some embodiments.

One or more examples of implementations are set forth in more detail in the accompanying drawings and the description of embodiments.

BRIEF DESCRIPTION OF THE DRAWINGS

Some embodiments will now be described with reference to the accompanying drawings, in which.

DETAILED DESCRIPTION

The following embodiments are only examples. Although the specification may refer to "an" embodiment in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments to consist of only those features that have been mentioned and such embodiments may contain also features/structures that have not been specifically mentioned.

Reference numbers in the description of the embodiments serve to illustrate the embodiments with reference to the drawings, without limiting it to these examples only.

Figure 1A:
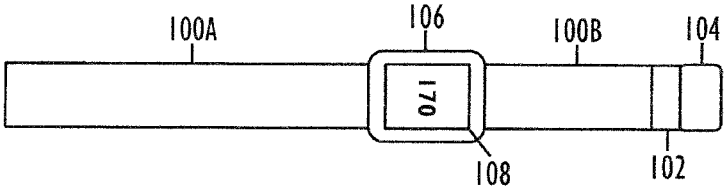
FIG. 1A, FIG. 1B and FIG. 1C illustrate top, side and bottom views of embodiments of a watch strap attached to a smartwatch.
Figure 1B:
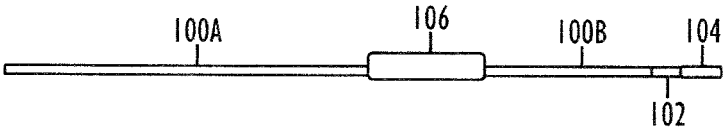
Figure 1C:
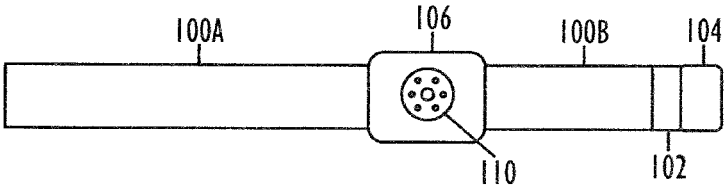

Let us study FIG. 1A, FIG. 1B and FIG. 1C illustrating a watch strap attached to a smartwatch 106.

The watch strap comprises a substantially inflexible main portion 100A, 100B, and a flexible auxiliary portion 102 coupled to the substantially inflexible main portion 100A, 100B.

In an embodiment, the substantially inflexible main portion 100A, 100B comprises inflexible textile material. Alternatively, or additionally, the substantially inflexible main portion 100A, 100B may comprise nylon, polyurethane, thermoplastic polyurethane, plastic, composite, leather, and/or metal, for example. Note that the term "substantially inflexible" refers to such a material that remains inflexible when subjected to normal forces caused by a movement or swelling/shrinking of a wrist to which the watch strap is attached.

In an embodiment, the flexible auxiliary portion 102 comprises elastic material. The elastic material will return to its initial shape and size when a distorting influence or force is removed, whereby the watch strap will stay in place and remain comfortable. Suitable elastic materials include rubber, synthetic rubber, silicone, and other polymers (such as elastomers and plastics), for example.

The elasticity may be defined with Young's modulus, i.e., a mechanical measure of a stiffness of a solid material. Young's modulus defines the relationship between stress (force per unit area) and strain (proportional deformation) in a material in the linear elasticity regime of a uniaxial deformation. The Young's modulus predicts how much the flexible auxiliary portion 102 extends under tension. The Young's modulus may be applied to define the required elasticity of the flexible auxiliary portion 102 as tensile stress is mainly in one direction, along a longitudinal axis of the watch strap. The Young's modulus for rubber is 0.01-0.1 GPa (gigapascal), or for low-density polyethylene 0.11-0.86 GPa, whereby a suitable range for the material of the flexible auxiliary portion 102 may be about 0.01-0.1 GPa or 0.01-0.86 GPa.

Another measure worth mentioning here is the hardness of the material, which may be measured with a Shore durometer. A soft roller-skate wheel may have a durometer value of 78 and a rubber band a durometer value of 25. The material of the flexible auxiliary portion 102 may be relatively soft having a durometer value of about 25, for example, whereas the substantially inflexible main portion 100A, 100B may have a higher durometer value.

In an embodiment, the flexible auxiliary portion 102 has an elasticity of about 3 to 7 millimetres (when subjected to normal forces experienced by the watch strap when worn in the wrist). In an embodiment, the flexible auxiliary portion 102 has an elasticity of about 5 millimetres.

The watch strap also comprises a tightener 104 coupled to the flexible auxiliary portion 102.

When the watch strap is in use, the tightener 104 is configured to maintain a selected tightness, and the flexible auxiliary portion 102 is configured to be elastic. In this way, the tightener 104 allows the user to strap the watch strap around his/her wrist and to select a tightness (from a group of discrete values, or from a continuous range of values). The elasticity of the flexible auxiliary portion 102 allows for a certain margin for the selected tightness, whereby the fit of the watch strap will be responsive to changing circumstances (caused due to a motion of the wrist, swelling of the wrist, shrinking of the wrist, etc.). FIG. 3B and FIG. 3C illustrate the elasticity: the flexible auxiliary portion 102A has a width 320 in FIG. 3B, whereas in FIG. 3C the width 324 is greater than in FIG. 3B.

Figure 2A:
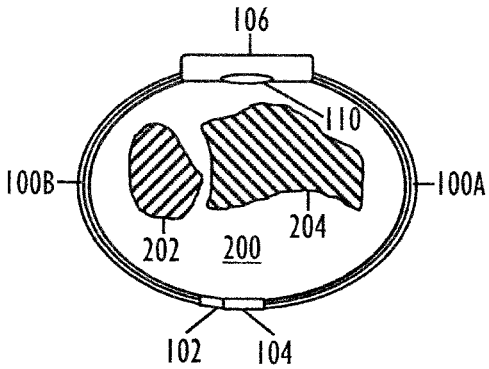
FIG. 2A, FIG. 2B and FIG. 2C illustrate cross section, back of a hand side and palm side views of embodiments of the watch strap when in use.
Figure 2B:
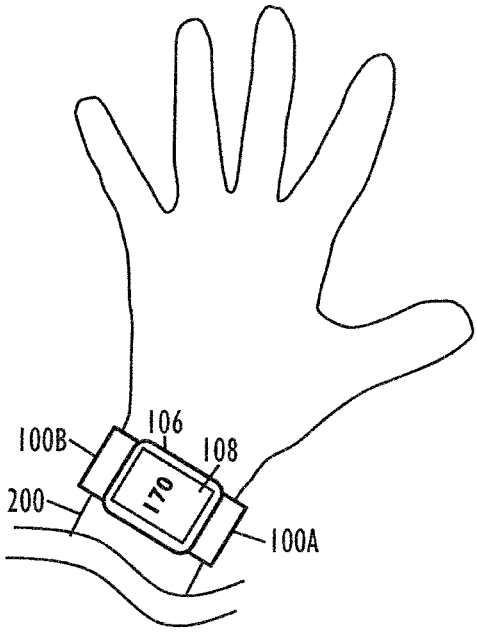

In an embodiment, the watch strap is configured to be attachable to a smartwatch 106 (or to a sports watch or a heart rate monitor) comprising an optical heart rate measurement unit 110. As shown in FIGS. 1A and 2B, a display 108 may show the measured heart rate value "170", for example. However, the watch strap may also be used to attach an electronic or mechanical device, such as a mechanical watch, a wrist loudspeaker, a wrist measurement device (for ultraviolet radiation, temperature, or noise, for example), or another type of wrist apparatus.

Figure 2C:
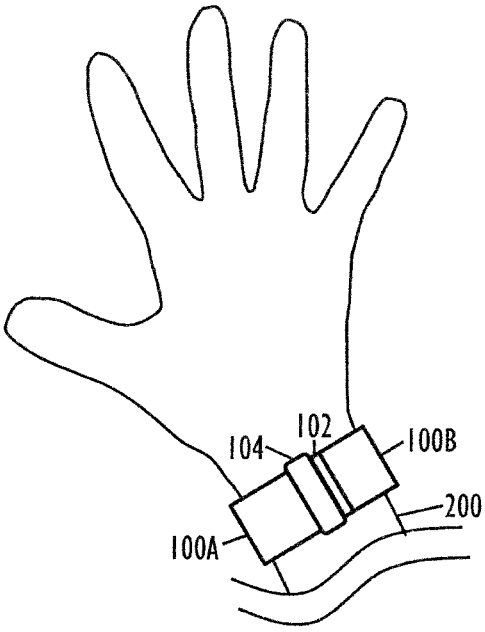

In an embodiment, an adjustability of the tightener 104 and an elasticity of the flexible auxiliary portion 102 is dimensioned such that the watch strap is configured to be strapped tight around a wrist 200 in order to ensure proper functioning of the optical heart rate measurement unit 110 and at the same time provide comfort due to the elasticity. As shown in FIGS. 1C and 2A, the optical heart rate measurement unit 110 may comprise a plurality of light-emitting diodes (LED) and photodiodes to be placed against skin of the user, and they should move as little as possible during the measurement, otherwise motion artefacts in the signal need to be filtered out, which may cause errors and increase power consumption. With the use of the illustrated watch strap, the measurement head of the optical heart rate measurement unit 110 will remain relatively stationary. FIG. 2A, FIG. 2B and FIG. 2C illustrate the watch strap strapped around the wrist 200: cross-sections of an ulna bone 202 and a radius bone 204 are also shown in FIG. 2A as their movement in relation to each other also inflicts motion of the watch strap.

In an embodiment illustrated in FIG. 3B, the watch strap further comprises a fixed loop 310 configured to cover a seam 312 between the substantially inflexible main portion 100B and the flexible auxiliary portion 102. This is both aesthetically pleasing and protective as the seam 312 is then not subjected to tear and wear. As shown in FIG. 3B, the watch strap may also comprise a loose loop 308 configured to receive an end 304 of the substantially inflexible main portion 100A illustrated in FIG. 3A.

In an embodiment, the substantially inflexible main portion 100A, 100B comprises two parts.

Figure 3A:
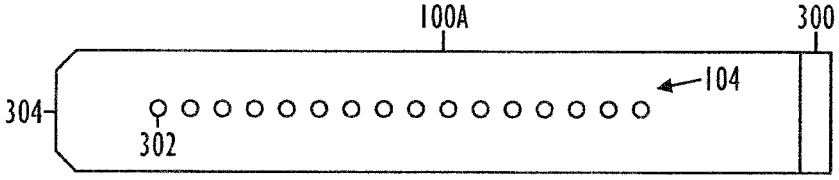
FIG. 3A, FIG. 3B, FIG. 3C, FIG. 3D and FIG. 4 illustrate embodiments of constructional details of the watch strap.
Figure 3B:
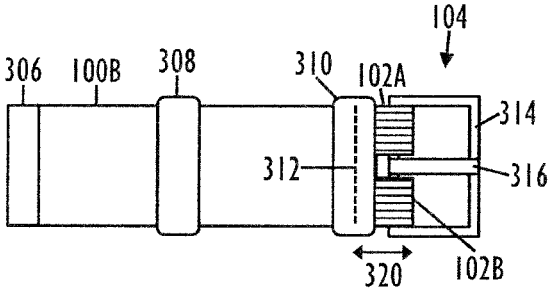
Figure 3C:
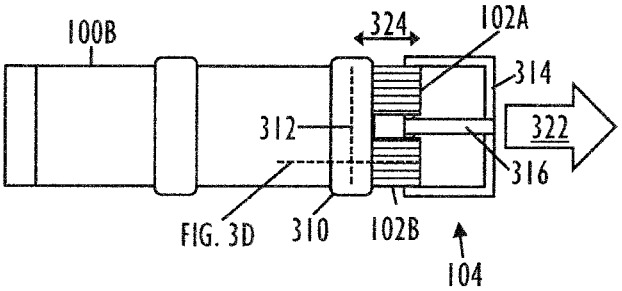

In an embodiment illustrated in FIG. 3A, a first part 100A comprises a fixing 300 to the wrist apparatus 106 in one end, and a part 302 of the tightener 104.

In an embodiment illustrated in FIG. 3B, a second part 100B comprises a fixing 306 to the wrist apparatus 106 in one end, and the flexible auxiliary portion 102 couples another end to a counterpart 314, 316 of the tightener 104.

In an embodiment illustrated in FIG. 3A and FIG. 3B, the tightener 104 comprises a buckle-type fastener. As shown in FIG. 3B, the buckle-type fastener comprises a loop-shaped frame 314 coupled to the flexible auxiliary portion 102, and a prong 316 coupled to the loop-shaped frame 314. As shown in FIG. 3A, the substantially inflexible main portion 100A comprises a plurality of holes 302 configured to accommodate the prong 316 when an end 304 of the substantially inflexible main portion 100A is placed through the loop-shaped frame 314.

It should be noted that the tightener 104 may be supplied instead of the buckle-type fastener with another means to fasten the watch strap such as a clasp-type fastener, or a clamp-type fastener, for example.

Figure 3D:
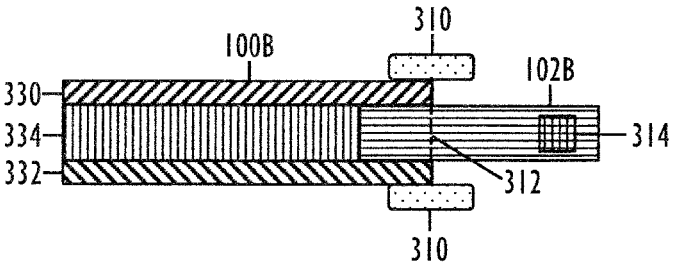

In an embodiment illustrated in FIG. 3D, showing a crosscut from FIG. 3C, the substantially inflexible main portion 100B comprises at least two layers 330, 332, and a part of the flexible auxiliary portion 102B is coupled between the at least two layers 330, 332. In FIG. 3D, the substantially inflexible main portion 100B comprises three layers: the outer layers 330, 332 and an inner layer 334. The coupling of the flexible auxiliary portion 102B to the substantially inflexible main portion 100B may be implemented by stitching, gluing, riveting, etc.

In an embodiment, the layer 332, which comes into contact with the wrist 200 when attached, comprises non-skid material, such as polyurethane, thermoplastic polyurethane (TPU), silicon, rubber, synthetic rubber, or other material with causes increased friction between the skin of wrist and the inside of the bracelet watch strap. Furthermore, said layer 332 may comprise appropriate texture to increase the friction. The increased friction may aid in preventing the watch strap from moving around the wrist 200.

Figure 4:
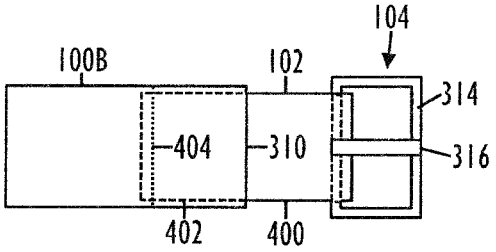

In an embodiment of FIG. 4, the substantially inflexible main portion 100B is configured to accommodate a part 402 of the flexible auxiliary portion 102. One way of implementing this is shown in FIG. 4: the part 402 is attached by a stitching 404 between the above-mentioned layers 330, 332, and the seam 310 is between the invisible part 402 and a visible part 400 of the flexible auxiliary portion 102. Another way to implement this is that, when in use, the substantially inflexible main portion 100B is configured to cover the invisible part 402.

Finally, let us study FIG. 5A, FIG. 5B, FIG. 6A, FIG. 6B and FIG. 7, which illustrate a stretch indicator configured to visualize a state of stretching of the flexible auxiliary portion 102. In this way, the watch strap may be tightened with the tightener 104 is configured to such a selected tightness, that there still remains elasticity in the flexible auxiliary portion 102 so that it may further regulate the tightness to ensure a proper fit (=tight enough but at the same time comfortable). In effect, the stretch indicator may also indicate a tension of the watch strap when worn. The stretching force (or tension) 322 is along the longitudinal axis of the watch strap.

Figure 5A:
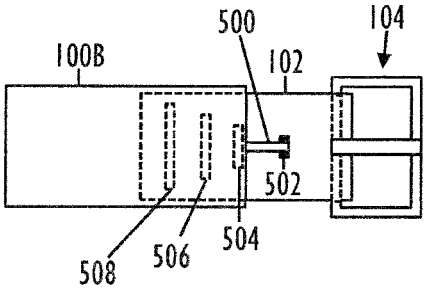
FIG. 5A, FIG. 5B, FIG. 6A, FIG. 6B and FIG. 7 illustrate embodiments of a stretch indicator.
Figure 5B:
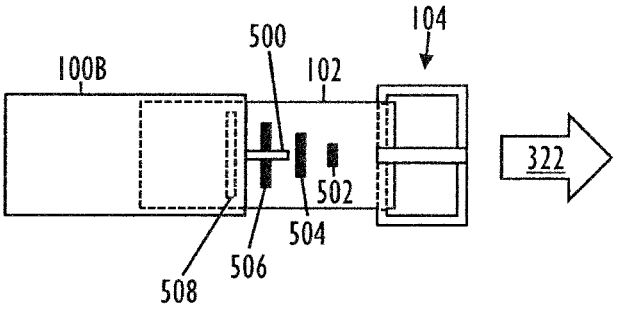

In an embodiment of FIG. 5A and FIG. 5B, the stretch indicator comprises scale markings 502, 504, 506, 508 on the flexible auxiliary portion 102. In FIG. 5A, the user has chosen a relaxed fit: only the first scale marking 502 is visible, which indicates to the user that there is no stretch in the flexible auxiliary portion 102. In contrast to FIG. 5A, the flexible auxiliary portion has stretched so that also the second scale marking 504 and the third scale marking 506 have become visible and only the fourth scale marking 508 remains invisible. As an addition to this embodiment, the stretch indicator may optionally comprise a pointer 500 fixed to the substantially inflexible main portion 100B. The right-hand side tip of the pointer 500 may indicate a precise stretch value. The pointer 500 may be made of non-flexible material such as plastic, and may have various shapes in addition to the illustrated bar shape such as a T-shape, the cross-line of T being the right-hand side tip.

Figure 6A:
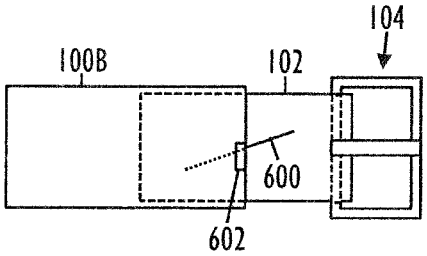
Figure 6B:
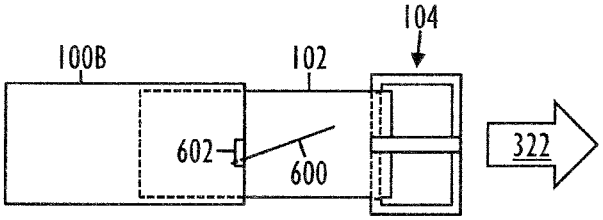
Figure 7:
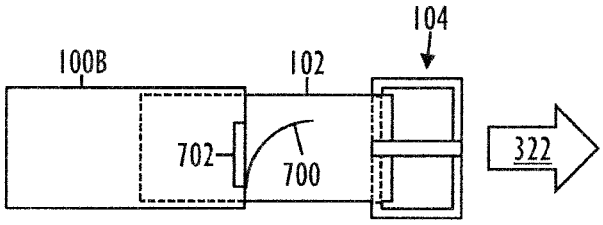

In an embodiment of FIG. 6A and FIG. 6B, the stretch indicator comprises a continuous scale marking 600 on the flexible auxiliary portion 102 and an allowed range 602 on the substantially inflexible main portion 100B. In FIG. 6A, the linear line 600 is on the upper side of the allowed range 602, indicating a minor stretch, whereas in FIG. 6B, the linear line 600 is on the lower side indicating a major stretch. FIG. 7 illustrates an alternative embodiment, instead of the linear line 600 an appropriate curve 700 is used, whereby the allowed range 702 is easier to observe. In FIG. 7, the stretch is about at the maximum.

Note that embodiments of FIG. 5A, FIG. 5B, FIG. 6A, FIG. 6B and FIG. 7 also utilize the embodiment of FIG. 4: the substantially inflexible main portion 100B is configured to accommodate a part of the flexible auxiliary portion 102, whereby that part extends and retracts during use due to the elasticity.

Even though the invention has been described with reference to one or more embodiments according to the accompanying drawings, it is clear that the invention is not restricted thereto but can be modified in several ways within the scope of the appended claims. All words and expressions should be interpreted broadly, and they are intended to illustrate, not to restrict, the embodiments. It will be obvious to a person skilled in the art that, as technology advances, the inventive concept can be implemented in various ways.

What is claimed is:

1. A watch strap comprising:

a substantially inflexible main portion;

a flexible auxiliary portion coupled to the substantially inflexible main portion; and a tightener coupled to the flexible auxiliary portion, wherein, when in use, the tightener is configured to maintain a selected tightness, and the flexible auxiliary portion is configured to be elastic, wherein, the flexible auxiliary portion comprises a single contiguous material directly coupling the substantially inflexible main portion to the tightener such that the flexible auxiliary portion is in direct contact with the substantially inflexible main portion and the tightener.

2. The watch strap of claim 1, wherein the substantially inflexible main portion comprises inflexible textile material.

3. The watch strap of claim 1, wherein the flexible auxiliary portion comprises elastic material.

4. The watch strap of claim 1, wherein the flexible auxiliary portion is made of material having Young's modulus of about 0.01-0.1 gigapascal or about 0.01-0.86 gigapascal.

5. The watch strap of claim 1, wherein the flexible auxiliary portion has an elasticity of about 3 to 7 millimetres.

6. The watch strap of claim 1, wherein the substantially inflexible main portion is configured to be attached to a smartwatch, the smartwatch comprising an optical heart rate measurement unit.

7. The watch strap of claim 6, wherein an adjustability of the tightener and an elasticity of the flexible auxiliary portion are configured to ensure proper functioning of the optical heart rate measurement unit and provide comfort due to the elasticity in response to the watch strap being strapped tightly around a wrist.

8. The watch strap of claim 1, further comprising a fixed loop configured to cover a seam between the substantially inflexible main portion and the flexible auxiliary portion.

9. The watch strap of claim 1, wherein the substantially inflexible main portion comprises two parts.

10. The watch strap of claim 9, wherein a first part of the substantially inflexible main portion comprises a first fixing at one end of the first part of the substantially inflexible main portion, the first fixing configured to be attached to a wrist apparatus, the first part of the substantially inflexible main portion comprising a part first portion of the tightener at another end of the first part of the substantially inflexible main portion.

11. The watch strap of claim 10, wherein a second part of the substantially inflexible main portion comprises a second fixing at one end of the second part of the substantially inflexible main portion, the second fixing configured to be attached to the wrist apparatus, the flexible auxiliary portion coupling another end of the second part of the substantially inflexible main portion to a second portion of the tightener.

12. The watch strap of claim 1, wherein the tightener comprises a buckle-type fastener.

13. The watch strap of claim 12, wherein the buckle-type fastener comprises:

a loop-shaped frame coupled to the flexible auxiliary portion; and a prong coupled to the loop-shaped frame, wherein the substantially inflexible main portion comprises a plurality of holes configured to accommodate the prong when an end of the substantially inflexible main portion is placed through the loop-shaped frame.

14. The watch strap of claim 1, wherein the substantially inflexible main portion comprises at least two layers, and a part of the flexible auxiliary portion is coupled between the at least two layers.

15. The watch strap of claim 1, wherein the substantially inflexible main portion is configured to accommodate a part of the flexible auxiliary portion.

16. The watch strap of claim 1, further comprising a stretch indicator configured to visualize a state of stretching of the flexible auxiliary portion.

17. The watch strap of claim 16, wherein the stretch indicator comprises scale markings on the flexible auxiliary portion.

18. The watch strap of claim 16, wherein the stretch indicator comprises a continuous scale marking on the flexible auxiliary portion and an allowed range on the substantially inflexible main portion.

* * * * *